US010871137B2

(12) United States Patent
Kontani et al.

(10) Patent No.: US 10,871,137 B2
(45) Date of Patent: Dec. 22, 2020

(54) FUEL SUPPLY DEVICE FOR INTERNAL COMBUSTION ENGINE

(71) Applicant: HONDA MOTOR CO., LTD., Tokyo (JP)

(72) Inventors: Masahiro Kontani, Wako (JP); Takahiko Shimizu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/497,234

(22) PCT Filed: Mar. 30, 2017

(86) PCT No.: PCT/JP2017/013248
§ 371 (c)(1),
(2) Date: Sep. 24, 2019

(87) PCT Pub. No.: WO2018/179217
PCT Pub. Date: Oct. 4, 2018

(65) Prior Publication Data

US 2020/0032757 A1 Jan. 30, 2020

(51) Int. Cl.
*F02M 69/46* (2006.01)
*F02M 55/02* (2006.01)
*F02M 61/14* (2006.01)

(52) U.S. Cl.
CPC ..... *F02M 69/465* (2013.01); *F02M 55/02* (2013.01); *F02M 61/145* (2013.01); *F02M 2200/857* (2013.01)

(58) Field of Classification Search
CPC .. F02M 69/465; F02M 69/044; F02M 61/145; F02M 55/02; F02M 2200/857;
(Continued)

(56) References Cited

U.S. PATENT DOCUMENTS 6,488,001 B2 12/2002 Suzuki et al.
7,093,584 B1 * 8/2006 Potter ..... F02M 55/04 123/447
(Continued)

FOREIGN PATENT DOCUMENTS

DE 10 2008 035 492 A1 2/2010
JP H06-81749 A 3/1994
(Continued)

OTHER PUBLICATIONS

Official Communication dated May 20, 2020 issued in the corresponding Japanese Patent Application No. 2019-508013.

*Primary Examiner* — George C Jin
(74) *Attorney, Agent, or Firm* — Carrier Blackman & Associates, P.C.; Joseph P. Carrier; William D. Blackman

(57) ABSTRACT

A fuel supply device for an internal combustion engine includes a plurality of fuel injection valves that are disposed side by side in an engine main body or in an intake system component forming part of an intake system, and a fuel distribution pipe that is connected in common to the fuel injection valves and supported via a support part provided on the intake system component or on the engine main body, wherein the fuel distribution pipe is formed from a pipe material, and a restricting member that is a separate member from the fuel distribution pipe is mounted on the support part at a position adjacent to the fuel distribution pipe so as to abut against the fuel distribution pipe to suppress displacement of the fuel distribution pipe from the support part. Thus, it is possible to suppress displacement of fuel piping while ensuring the mass productivity.

8 Claims, 8 Drawing Sheets

(58) Field of Classification Search
CPC ..... F02M 35/10072; F02M 35/10216; F02M 35/1165; F02M 35/162; F02M 35/12; F02B 77/13
See application file for complete search history.

(56) References Cited

U.S. PATENT DOCUMENTS

| | | | | |
|---|---|---|---|---|
| 2010/0012093 | A1* | 1/2010 | Pepperine ..... | F02M 55/004 123/470 |
| 2013/0125864 | A1* | 5/2013 | Kannan ..... | F02M 61/168 123/469 |
| 2018/0128223 | A1* | 5/2018 | Park ..... | F02M 55/005 |

FOREIGN PATENT DOCUMENTS

| | | | |
|---|---|---|---|
| JP | H09-310662 | A | 12/1997 |
| JP | 2000-073903 | A | 3/2000 |
| JP | 2001-263195 | A | 9/2001 |
| JP | 2002-130077 | A | 5/2002 |
| JP | 2004-076728 | A | 3/2004 |
| JP | 2005-325730 | A | 11/2005 |
| JP | 3841258 | B2 | 11/2006 |
| JP | 2009-293419 | A | 12/2009 |
| JP | 2010-077959 | A | 4/2010 |
| JP | 2012-052458 | A | 3/2012 |
| JP | 2013-072430 | A | 4/2013 |
| JP | 2016-065513 | A | 4/2016 |

* cited by examiner

FUEL SUPPLY DEVICE FOR INTERNAL COMBUSTION ENGINE

TECHNICAL FIELD

The present invention relates to a fuel supply device for an internal combustion engine that includes a plurality of fuel injection valves that are disposed side by side in an engine main body of an internal combustion engine or in an intake system component forming part of an intake system connected to the engine main body, and a fuel distribution pipe that is connected in common to the fuel injection valves and supported via a support part provided on the intake system component or on the engine main body.

BACKGROUND ART

A fuel supply device for an internal combustion engine in which a fuel distribution pipe for supplying fuel to a plurality of fuel injection valves is formed into a long block shape in order to ensure the stiffness thereof is known from Patent Document 1.

RELATED ART DOCUMENTS

Patent Documents

Patent Document 1: Japanese Patent No. 3841258

SUMMARY OF THE INVENTION

Problems to be Solved by the Invention

However, in the arrangement disclosed in Patent Document 1 above, although it is effective for ensuring the stiffness of the fuel distribution pipe, there is still room for improvement in terms of mass productivity due to problems such as complication of machining.

The present invention has been accomplished in light of such circumstances, and it is an object thereof to provide a fuel supply device for an internal combustion engine that can suppress displacement of fuel piping while ensuring the mass productivity.

Means for Solving the Problems

In order to attain the above object, according to a first aspect of the present invention, there is provided a fuel supply device for an internal combustion engine, comprising a plurality of fuel injection valves that are disposed side by side in an engine main body of an internal combustion engine or in an intake system component forming part of an intake system connected to the engine main body, and a fuel distribution pipe that is connected in common to the fuel injection valves and supported via a support part provided on the intake system component or on the engine main body, characterized in that the fuel distribution pipe is formed from a pipe material, and a restricting member that is a separate member from the fuel distribution pipe is mounted on the support part at a position adjacent to the fuel distribution pipe so as to abut against the fuel distribution pipe to suppress displacement of the fuel distribution pipe from the support part.

Further, according to a second aspect of the present invention, in addition to the second aspect, the restricting member is formed from a plate material into a bowl shape having a ceiling wall and a peripheral wall connected to an outer peripheral edge of the ceiling wall, and a restricting wall portion abutting against the fuel distribution pipe is formed on part of the peripheral wall.

According to a third aspect of the present invention, in addition to the second aspect, a recess part for avoiding interference with the fuel injection valve is formed by cutting out part of the peripheral wall of the restricting member.

According to a fourth aspect of the present invention, in addition to the second or third aspect, a through hole is formed in the ceiling wall of the restricting member, a lead wire guided out from the fuel injection valve being inserted through the through hole.

According to a fifth aspect of the present invention, in addition to any one of the first to fourth aspects, the restricting member is fastened to the support part by means of a plurality of fastening members arranged side by side in a direction orthogonal to a longitudinal direction of the fuel distribution pipe.

According to a sixth aspect of the present invention, in addition to the fifth aspect, the restricting member and a stay for fixing the fuel distribution pipe are together fastened to the support part by means of one of a pair of the fastening members.

According to a seventh aspect of the present invention, in addition to any one of the first to sixth aspects, a plurality of the restricting members arranged side by side in the longitudinal direction of the fuel distribution pipe are disposed at a plurality of locations spaced in the longitudinal direction of the fuel distribution pipe.

Moreover, according to an eighth aspect of the present invention, in addition to the seventh aspect, a pair of the restricting members are disposed so as to coincide with opposite end parts of the fuel distribution pipe, and the restricting members and the fuel distribution pipe are covered in common by a cover member.

An intake manifold 25 of an embodiment corresponds to the intake system component of the present invention, bolts 53 and 54 of the embodiment correspond to the fastening member of the present invention, and manifold covers 60L and 60R of the embodiment correspond to the cover member of the present invention.

Effects of the Invention

In accordance with the first aspect of the present invention, since, while using the fuel distribution pipe made from a pipe material, displacement of the fuel distribution pipe from the support part is suppressed by means of the restricting member, which is a member separate from the fuel distribution pipe, it is possible to realize strong fixing by suppressing displacement of the fuel distribution pipe by means of restriction by the restricting member while ensuring the mass productivity of the fuel distribution pipe by not forming the fuel distribution pipe from a member with a special shape.

Furthermore, in accordance with the second aspect of the present invention, since the restricting member formed from a plate material is formed into a bowl shape and the restricting wall as a part of the peripheral wall of the restricting member is abutted against the fuel distribution pipe, it is possible to form a stiff restricting member using an inexpensive plate material.

In accordance with the third aspect of the present invention, due to the recess part being formed by cutting out part of the peripheral wall of the restricting member, it is possible to easily dispose the restricting member in the vicinity of the fuel distribution pipe while avoiding interference between the fuel injection valve and the restricting member, and to reliably restrict displacement of the fuel distribution pipe by means of the restricting member.

In accordance with the fourth aspect of the present invention, since the lead wire guided out from the fuel injection valve is inserted through the through hole formed in the ceiling wall of the restricting member, it is possible to dispose the restricting member at a position where it is the most effective by avoiding any influence on the placement of the lead wire from the placement of the restricting member.

In accordance with the fifth aspect of the present invention, since the restricting member is fastened to the support part by means of the plurality of fastening members arranged side by side in the direction orthogonal to the longitudinal direction of the fuel distribution pipe, it is possible to enhance the stiffness with which the restricting member is mounted on the support part.

In accordance with the sixth aspect of the present invention, since the restricting member and the stay for fixing the fuel distribution pipe are together fastened to the support part by means of the pair of fastening members, it is possible to eliminate the necessity for a component exclusively used for fixing the stay to the support part, thus reducing the number of components.

In accordance with the seventh aspect of the present invention, due to the restricting member being disposed at a plurality of locations spaced in the longitudinal direction of the fuel distribution pipe, even if the fuel distribution pipe is formed so as to be long, it is possible to retain and restrict the fuel distribution pipe uniformly in the longitudinal direction by means of the plurality of restricting members.

Furthermore, in accordance with the eighth aspect of the present invention, since the pair of restricting members are disposed so as to coincide with the opposite end parts of the fuel distribution pipe, and the restricting members and the fuel distribution pipe are covered in common by the cover member, the range covered by the cover member becomes large, and the cover member can be fixed easily.

EXPLANATION OF REFERENCE NUMERALS AND SYMBOLS

Figure 1:
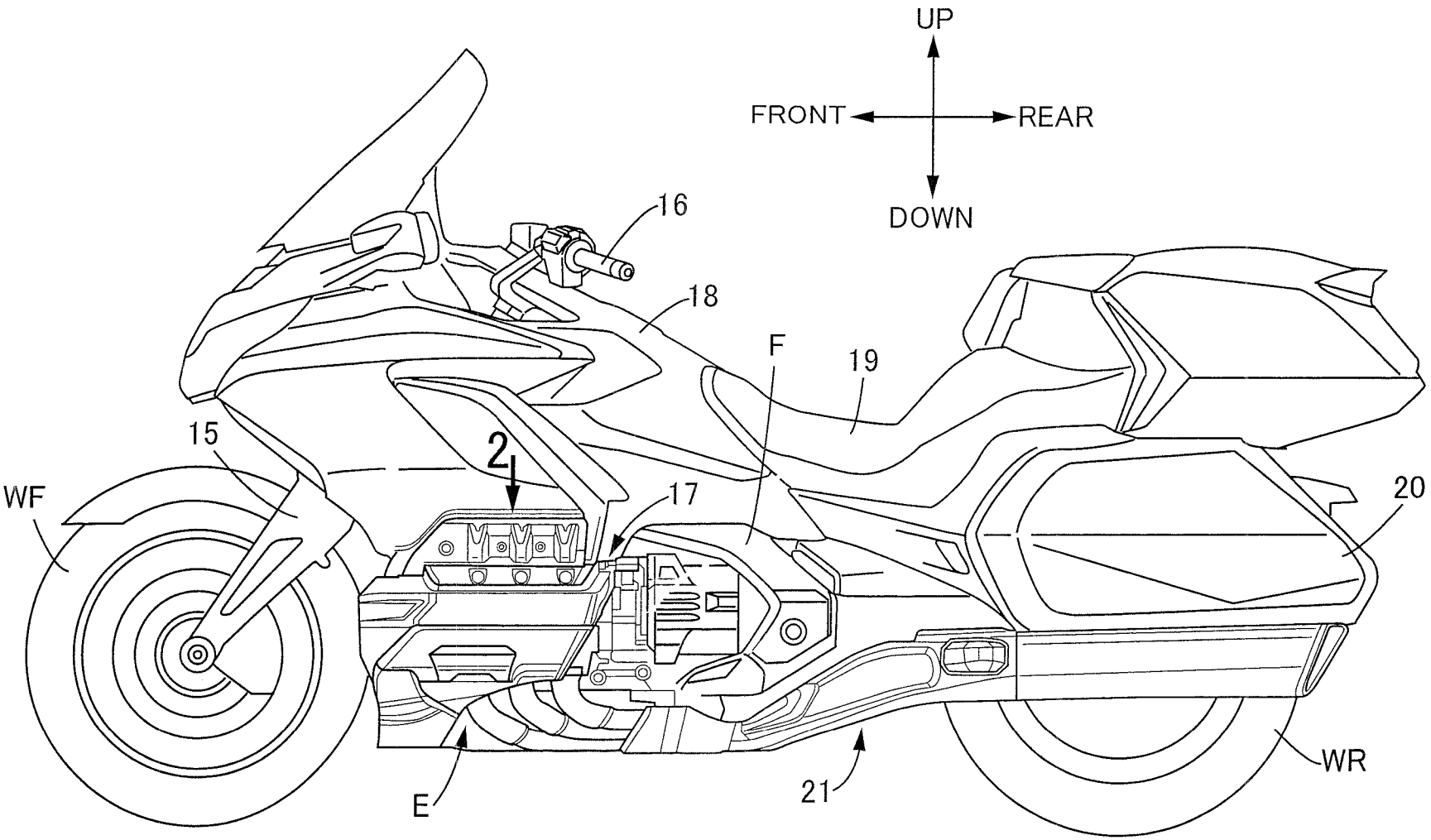
FIG. 1 is a left side view of a two-wheeled motor vehicle. (first embodiment)

17 Engine main body
23 Intake system
25 Intake manifold, which is an intake system component
33 Fuel injection valve
34L, 34R Fuel distribution pipe
44 Stay
45 Support part
46 Restricting member
46*a* Ceiling wall
46*b* Peripheral wall
46*ba* Restricting wall portion
48 Recess part
51 Lead wire
52 Through hole
53, 54 Bolt, which is a fastening member
60L, 60R Manifold cover, which is a cover member
E Internal combustion engine

MODES FOR CARRYING OUT THE INVENTION

An embodiment of the present invention is explained by reference to FIG. 1 to FIG. 8. In the explanation below, front and rear, up and down, and left and right mean directions as viewed by a person riding a two-wheeled motor vehicle.

First Embodiment

First, in FIG. 1, a front fork 15 and bar-shaped steering handlebars 16 are steerably supported on a front end part of a vehicle body frame F of this two-wheeled motor vehicle, a front wheel WF being axially supported on a lower end part of the front fork 15, and an engine main body 17 of an internal combustion engine E, which is a horizontally-opposed six cylinder engine exerting power for driving a rear wheel WR, is mounted on the vehicle body frame F so that three cylinders are disposed on each of left and right sides. A fuel tank 18 disposed above the engine main body 17 is supported on the vehicle body frame F, a riding seat 19 is disposed to the rear of the fuel tank 18, and a saddle bag 20 is disposed beneath the left and the right sides of a rear part of the riding seat 19.

An exhaust system 21 of the internal combustion engine E is formed so that a portion that is connected to a left cylinder head 24L (see FIG. 2) of the engine main body 17 and a portion that is connected to a right cylinder head 24R (see FIG. 2) of the engine main body 17 are disposed separately on left and right sides of the rear wheel WR.

Figure 2:
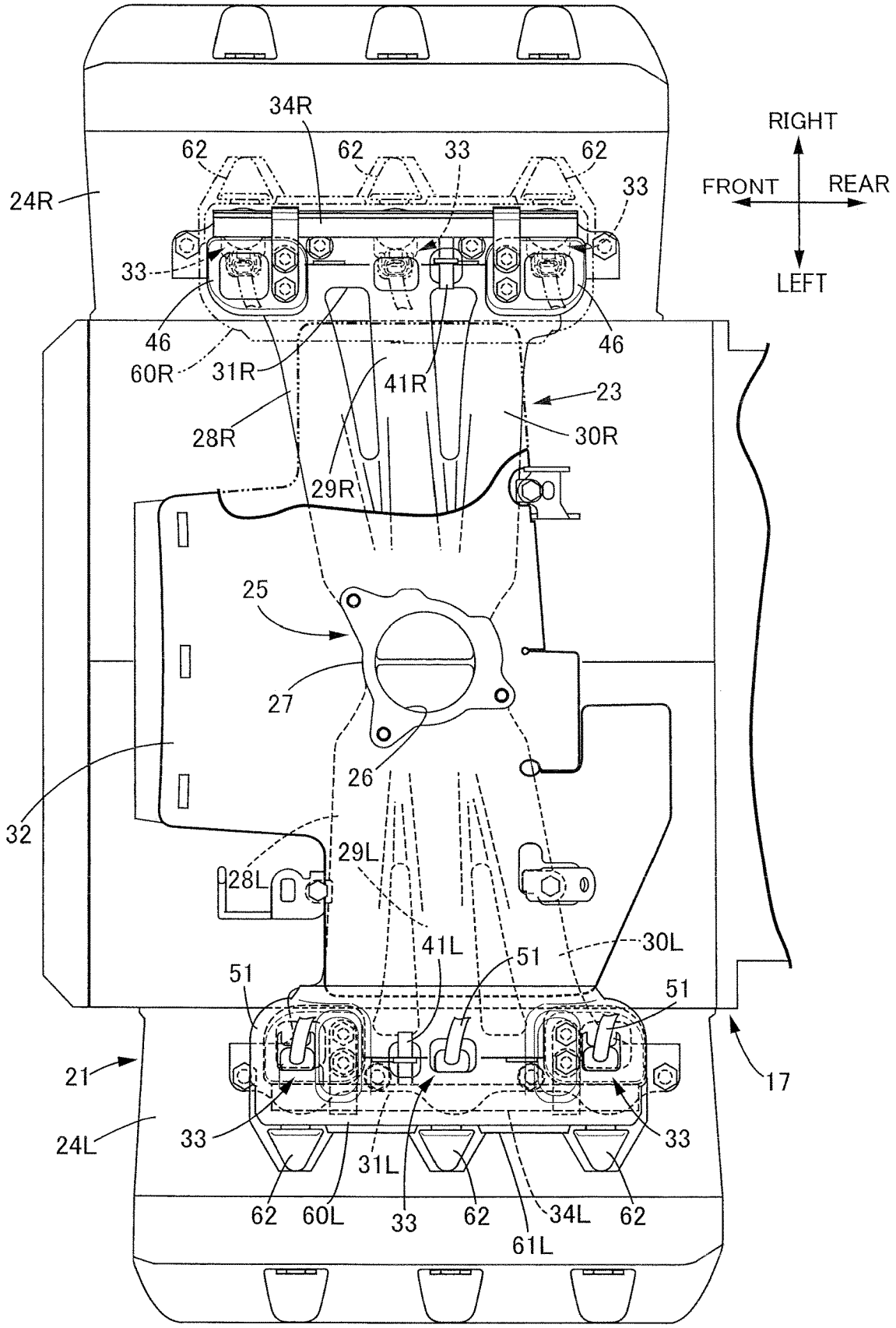
FIG. 2 is a plan view of an essential part of an internal combustion engine when viewed from the direction of arrow 2 in FIG. 1. (first embodiment)

In FIG. 2, an intake system 23 of the internal combustion engine E includes an intake manifold 25, and an air cleaner (not illustrated) that is provided in a middle part of the intake manifold 25 and is disposed above the intake manifold 25 so as to communicate with a common intake port 26 opening upward.

The intake manifold 25 is formed so as to integrally have a common inlet part 27 in which the common intake port 26 is formed, right first, second, and third branched pipe parts 28R, 29R, and 30R that have left end parts in the vehicle width direction communicating in common with the common inlet part 27 and are branched so as to spread from the common inlet part 27 toward the right in the vehicle width direction, left first, second, and third branched pipe parts 28L, 29L, and 30L that have right end parts in the vehicle width direction communicating in common with the common inlet part 27 and are branched so as to spread from the common inlet part 27 toward the left in the vehicle width direction, a right linking part 31R that links in common right end parts in the vehicle width direction of the right first, second, and third branched pipe parts 28R, 29R, and 30R, and a left linking part 31L that links in common left end parts in the vehicle width direction of the left first, second, and third branched pipe parts 28L, 29L, and 30L. The right linking part 31R is fastened to the right cylinder head 24R, and the left linking part 31L is fastened to the left cylinder head 24R. The majority of the intake manifold 25 is covered by a sheet 32 from above.

A plurality of fuel injection valves 33 are disposed in the intake manifold 25, which is an intake system component forming part of the intake system 23, or in the engine main body 17 so as to individually correspond to the respective cylinders, and in this embodiment six fuel injection valves 33 corresponding to the respective cylinders are disposed in the right first, second, and third branched pipe parts 28R, 29R, and 30R and the left first, second, and third branched pipe parts 28L, 29L, and 30L of the intake manifold 25 so as to be arranged side by side in the vehicle fore-and-aft direction.

The three fuel injection valves 33 disposed in the right first, second, and third branched pipe parts 28R, 29R and 30R are connected in common to a right fuel distribution pipe 34R that is formed from a pipe material extending in the vehicle fore-and-aft direction and has opposite ends closed, and the three fuel injection valves 33 disposed in the left first, second, and third branched pipe parts 28L, 29L and 30L are connected in common to a left fuel distribution pipe 34L that is formed from a pipe material extending in the vehicle fore-and-aft direction and has opposite ends closed.

Figure 3:
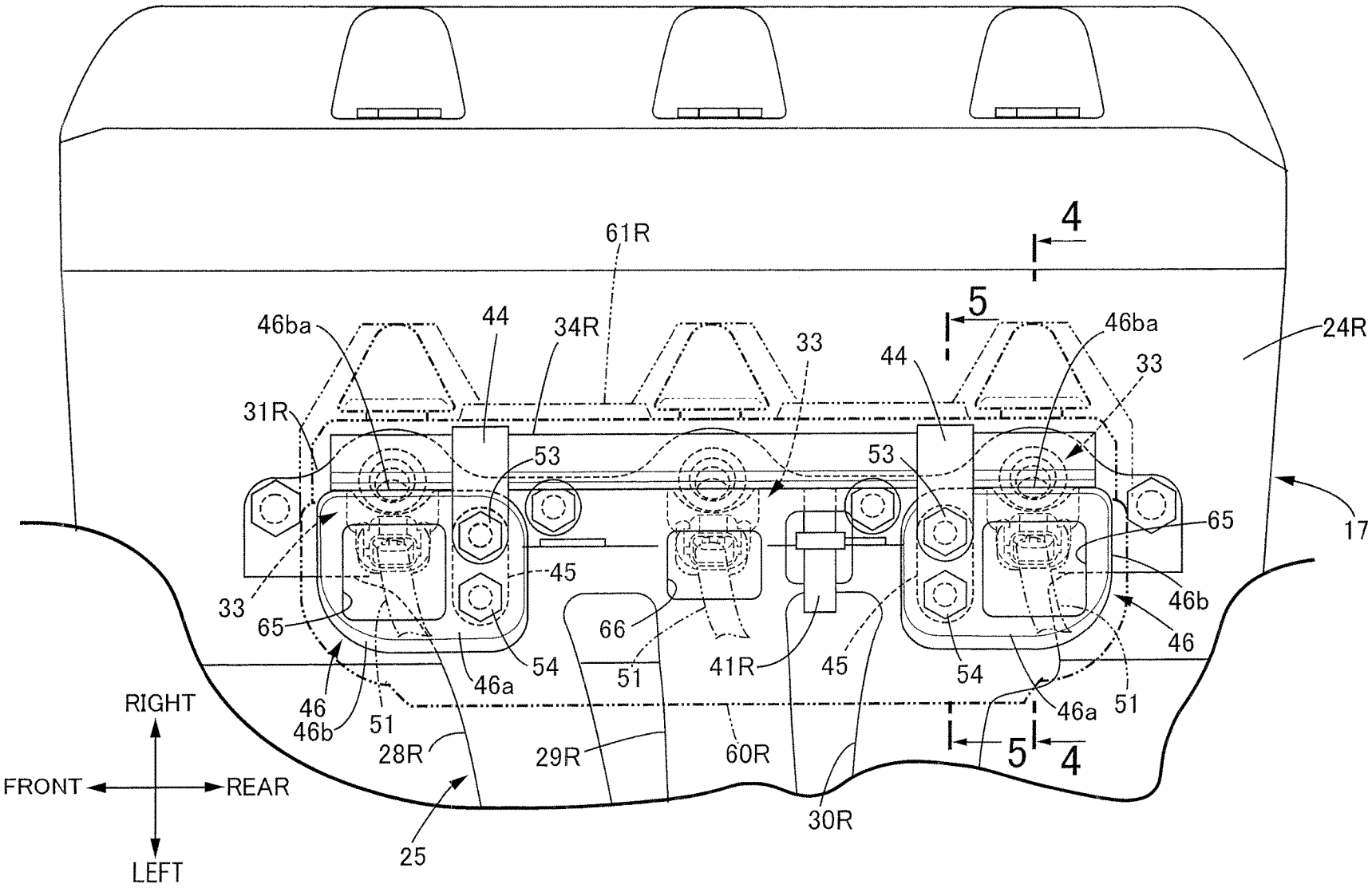
FIG. 3 is an enlarged view of an essential part of FIG. 2. (first embodiment)
Figure 4:
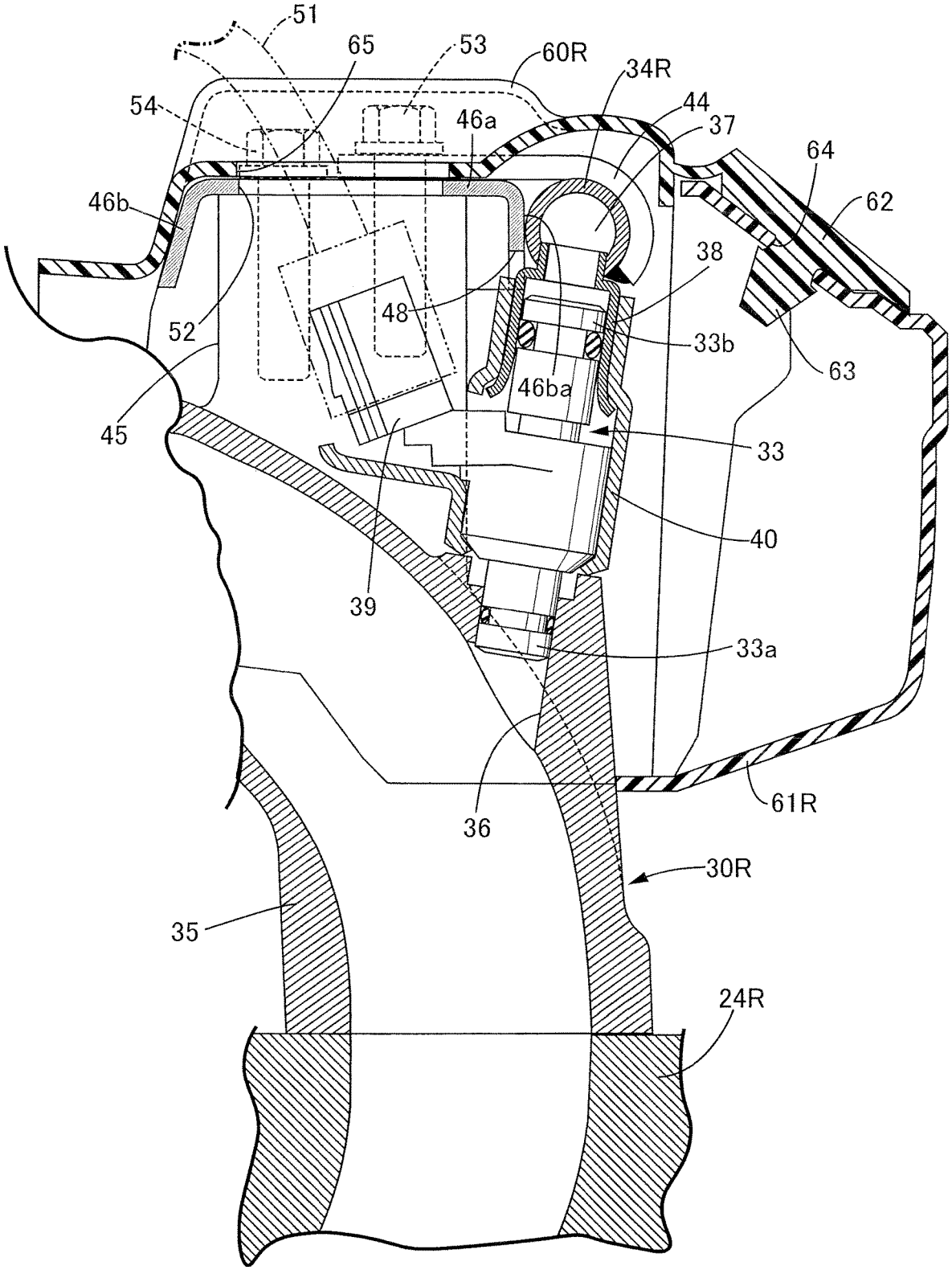
FIG. 4 is a sectional view along line 4-4 in FIG. 3. (first embodiment)

Referring in addition to FIG. 3 and FIG. 4, the downstream end of the right third branched pipe part 30R in the intake manifold 25 is formed so as to curve toward the right cylinder head 24R side, and the fuel injection valve 33 is disposed in a curved part 35 of the right third branched pipe part 30R. That is, a valve mounting hole 36 extending in the vertical direction is formed in the curved part 35, and the fuel injection valve 33 is disposed in the curved part 35 while having an extremity portion 33*a* thereof liquid-tightly fitted into the valve mounting hole 36.

A valve housing 38 communicating with a fuel passage 37 within the fuel distribution pipe 34R is welded to a portion, corresponding to the fuel injection valve 33, of a lower side wall of the right the fuel distribution pipe 34R, and a rear end portion 33*b* of the fuel injection valve 33 is liquid-tightly fitted into the valve housing 38, thus allowing fuel to be supplied from the right fuel distribution pipe 34R to the fuel injection valve 33.

The fuel injection valve 33 has a coupler 39 projecting from a side wall, facing inward in the vehicle width direction, of the fuel injection valve 33, and a portion of the fuel injection valve 33 excluding the extremity portion 33*a* and the coupler 39 is, together with part of the valve housing 38, covered by a valve cover 40.

The structure via which the fuel injection valve 33 is disposed in the right first and second branched pipe parts 28R and 29R and the structure via which fuel injection valve 33 is disposed in the left first, second, and third branched pipe parts 28L, 29L and 30R are basically the same as the structure via which the fuel injection valve 33 is disposed in the right third branched pipe part 30R; the structure via which the fuel injection valve 33 disposed in the right first and second branched pipe parts 28R and 29R is connected to the right fuel distribution pipe 34R and the structure via which the fuel injection valve 33 disposed in the left first, second and third branched pipe parts 28L, 29L and 30R is connected to the left fuel distribution pipe 34L are basically the same as the structure via which the fuel injection valve 33 disposed in the right third branched pipe part 30R is connected to the left fuel distribution pipe 34R.

Connecting pipes 41R and 41L extending inward in the vehicle width direction are welded to the right fuel distribution pipe 34R and the left fuel distribution pipe 34L, and a fuel hose (not illustrated) is connected to the connecting pipes 41R and 41L.

A stay 44 extending inward in the vehicle width direction is fixed by welding to the right fuel distribution pipe 34R at positions corresponding a portion close to the right first branched pipe part 28R between the right first and second branched pipe parts 28R and 29R of the intake manifold 25 and a portion close to the right third branched pipe part 30R between the right second and third branched pipe parts 29R and 30R of the intake manifold 25, the stay 44 being for fixing the fuel distribution pipe 34R.

Figure 5:
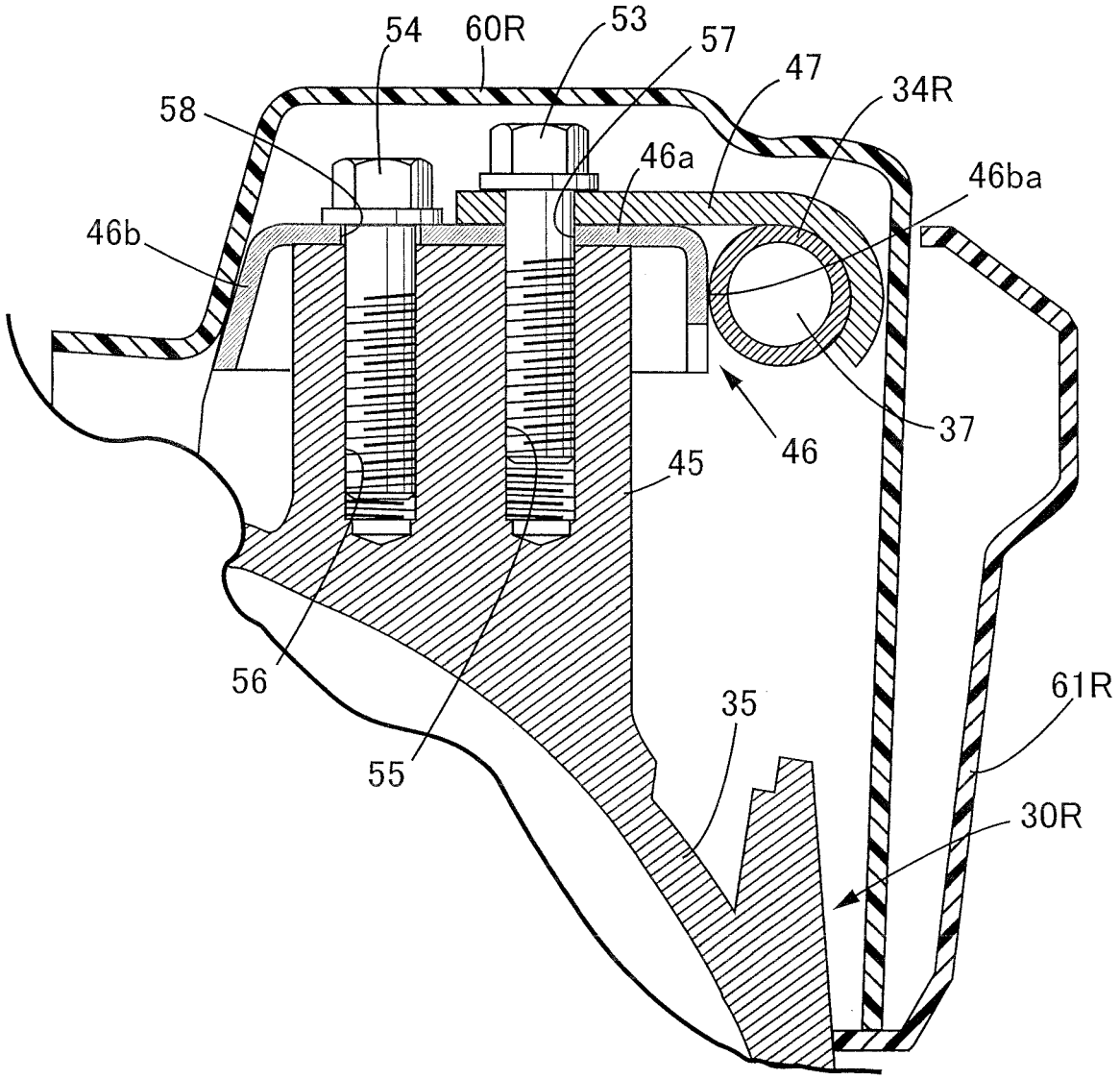
FIG. 5 is a sectional view along line 5-5 in FIG. 3. (first embodiment)

Referring in addition to FIG. 5, a support part 45 is projectingly provided integrally with the downstream end of the right third branched pipe part 30R so as to project upward, the support part 45 being disposed at a position adjacent, in the vehicle fore-and-aft direction, to the fuel injection valve 33 mounted on the third branched pipe part, and one of a pair of the stays 44 fixed to the right fuel distribution pipe 34R is fastened to an upper end part of the support part 45. A support part (not illustrated) similar to the support part 45 is also projectingly provided integrally with the downstream end of the right first branched pipe part 28R, and the other of the pair of stays 44 is fastened to the support part. The right fuel distribution pipe 34R is thereby mounted on the pair of support parts 45 provided on the intake manifold 25, and the fuel injection valves 33 are held between the right fuel distribution pipe 34R and the right first, second, and third branched pipe parts 28R, 29R, and 30R in the intake manifold 25.

A restricting member 46, which is a member separate from the right fuel distribution pipe 34R, is mounted on the support part 45 so as to abut against the right fuel distribution pipe 34R while being adjacent to the right fuel distribution pipe 34R, thus suppressing displacement of the fuel distribution pipe 34R from the support part 45.

Figure 6:
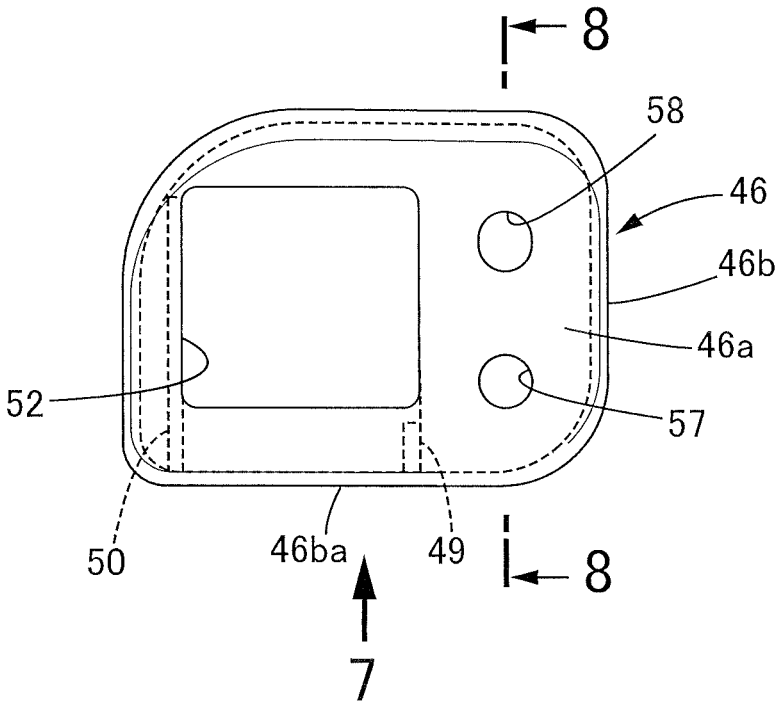
FIG. 6 is a plan view of a restricting member. (first embodiment)
Figure 7:
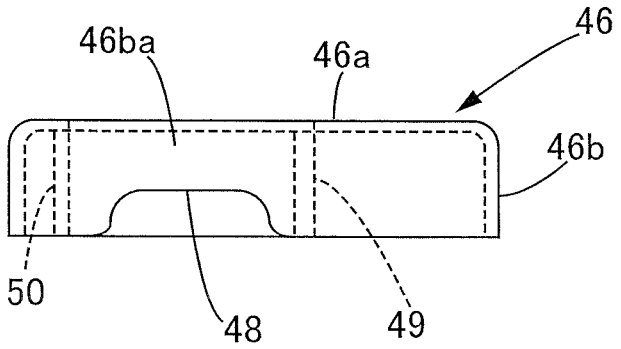
FIG. 7 is a view in the direction of arrow 7 in FIG. 6. (first embodiment)
Figure 8:
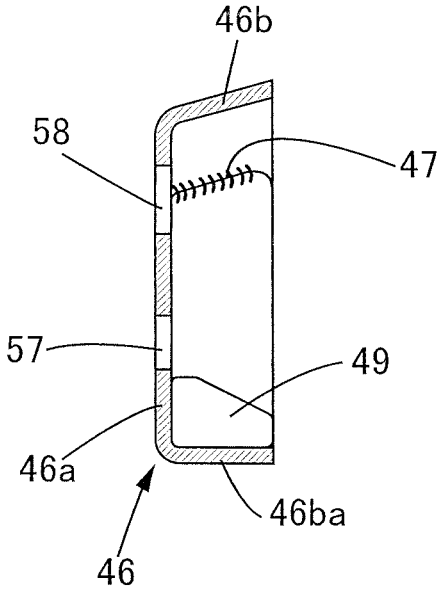
FIG. 8 is a sectional view along line 8-8 in FIG. 6. (first embodiment)

Referring in addition to FIG. 6 to FIG. 8, the restricting member 46 is formed by bending a plate material and is formed into a bowl shape, while having a ceiling wall 46*a* and a peripheral wall 46*b* connected to the outer peripheral edge of the ceiling wall 46*a*, so as to leave a welded part 47 at one position of the peripheral wall 46*b*, and a flat restricting wall portion 46*ba* abutting against the right fuel distribution pipe 34R is formed on part of the peripheral wall 46*b*.

A recess part 48 is formed in the peripheral wall 46*b* of the restricting member 46 by cutting out part of the peripheral wall 46*b*, the recess part 48 being for avoiding interference with the fuel injection valve 33 mounted on the right third branched pipe part 30R. Moreover, reinforcing walls 49 and 50 are welded to an inner face of the peripheral wall 46*b* and an inner face of the ceiling wall 46*a* at positions sandwiching the recess part 48 from opposite sides.

A rectangular through hole 52 is formed in the ceiling wall 46*a* of the restricting member 46, a lead wire 51 connected to the coupler 39 of the fuel injection valve 33 and guided out from the fuel injection valve 33 being inserted through the through hole 52.

The restricting member 46 is fastened to the support part 45 by means of a plurality, for example a pair, of fastening members arranged side by side in a direction (in this embodiment the vehicle width direction) orthogonal to the longitudinal direction of the right fuel distribution pipe 34R (in this embodiment the vehicle fore-and-aft direction), and in this embodiment it is fastened to the support part 45 by means of a pair of bolts 53 and 54, which are the pair of fastening members.

Moreover, the restricting member 46 and the stay 44 secured to the right fuel distribution pipe 34R are together fastened to the support part 45 by means of, among the pair of bolts 53 and 54, one bolt 53 disposed closer to the right fuel distribution pipe 34R.

Bottomed first and second threaded holes 55 and 56 are provided in the support part 45 in order for the bolts 53 and 54 to be screwed into. A first through hole 57 for the bolt 53 screwed into the first threaded hole 55 to be inserted through and a second through hole 58 for the bolt 54 screwed into the second threaded hole 56 to be inserted through are provided in the ceiling wall 46*a* of the restricting member 46, and the second through hole 58 is formed into an elongated hole shape that is long in a direction in which the bolts 53 and 54 are arranged side by side.

A plurality, for example a pair, of the restricting members 46 arranged side by side in the longitudinal direction of the right fuel distribution pipe 34R are disposed at a plurality of locations spaced in the longitudinal direction of the right fuel distribution pipe 34R, and in this embodiment a pair of the restricting members 46 are disposed so as to coincide with opposite end parts of the right fuel distribution pipe 34R. That is, the support part 45 projectingly provided on the first and third branched pipe parts 28R and 30R of the intake manifold 25 is disposed so as to coincide with the opposite end parts of the right fuel distribution pipe 34R.

The pair of restricting members 46 and the right fuel distribution pipe 34R are covered in common by a right manifold cover 60R, which is a cover member. On the other hand, the intake manifold 25 is covered, from the right side in the vehicle width direction, by a right intake pipe cover 61R fastened to the intake manifold 25, and an engagement projection part 63 is projectingly provided on an extremity part of an elastic tongue piece 62 formed at three locations spaced in the vehicle fore-and-aft direction of the right manifold cover 60R, which is formed from a synthetic resin, the engagement projection part 63 resiliently engaging with a latching hole 64 formed in the right intake pipe cover 61R so as to correspond to the elastic tongue piece 62. That is, the right manifold cover 60R is fixed to the right intake pipe cover by resiliently engaging the engagement projection part 63 with the latching hole 64 of the right intake pipe cover 61R.

A rectangular opening 65 is formed in the right intake pipe cover 61R so as to correspond to the through hole 52 of the restricting member 46, the lead wire 51 connected to the fuel injection valve 33 disposed in the right first and third branched pipe parts 28R and 30R being inserted through the opening 65, and a rectangular opening 66 is formed in the right intake pipe cover 61R, the lead wire 51 connected to the fuel injection valve 33 disposed in the right second branched pipe part 29R being inserted through the rectangular opening 66.

The structure via which the left fuel distribution pipe 34L is mounted on the intake manifold 25 and the structure via which displacement of the left fuel distribution pipe 34L is suppressed are basically the same as the structure via which the right fuel distribution pipe 34R is mounted on the intake manifold 25 and the structure via which displacement of the right fuel distribution pipe 34R is suppressed, and corresponding parts are denoted by the same reference numerals and symbols and only illustrated, detailed explanation thereof being omitted. The left fuel distribution pipe 34L, together with the pair of restricting members 46, is covered in common by the left manifold cover 60L, and the left manifold cover 60L is fixed to a left intake pipe cover 61L fastened to the intake manifold 25 and covering the intake manifold 25 from the left in the vehicle width direction.

The operation of this embodiment is now explained; since the right and left fuel distribution pipes 34R and 34L supported by the support part 45 provided on the intake manifold 25 are formed from a pipe material, and the restricting member 46, which is a member separate from the fuel distribution pipes 34R and 34L, is mounted on the support part 45 at a position adjacent to the right and left fuel distribution pipes 34R and 34L so as to abut against the right and left fuel distribution pipes 34R and 34L and suppress displacement of the fuel distribution pipes 34R and 34L from the support part 45, while using the right and left fuel distribution pipes 34R and 34L formed from a pipe material, displacement of the right and left fuel distribution pipes 34R and 34L from the support part 45 is suppressed by means of the restricting member 46, and it is thus possible to realize strong fixing by suppressing displacement of the right and left fuel distribution pipes 34R and 34L by means of restriction by the restricting member 46 while ensuring the mass productivity of the right and left fuel distribution pipes 34R and 34L by not forming the right and left fuel distribution pipes 34R and 34L from a member with a special shape.

Furthermore, since the restricting member 46 formed from a plate material is formed into a bowl shape having the ceiling wall 46*a* and the peripheral wall 46*b* connected to the outer peripheral edge of the ceiling wall 46*a*, and the restricting wall portion 46*ba* abutting against the right and left fuel distribution pipes 34R and 34L is formed on part of the peripheral wall 46*b*, it is possible to form a stiff restricting member 46 using an inexpensive plate material.

Moreover, since the recess part 48 for avoiding interference with the fuel injection valve 33 is formed by cutting out part of the peripheral wall 46*b* of the restricting member 46, it is possible to easily dispose the restricting member 46 in the vicinity of the right and left fuel distribution pipes 34R and 34L while avoiding interference between the coupler 39 of the fuel injection valve 33 and the restricting member 46, and to reliably restrict displacement of the right and left fuel distribution pipes 34R and 34L by means of the restricting member 46.

Furthermore, since the through hole 52, through which the lead wire 51 guided out from the fuel injection valve 33 is inserted, is formed in the ceiling wall 46*a* of the restricting member 46, it is possible to dispose the restricting member 46 at a position where it is the most effective by avoiding any influence on the placement of the lead wire 51 from the placement of the restricting member 46.

Moreover, since the restricting member 46 is fastened to the support part 45 by means of the plurality of bolts 53 and 54 arranged side by side in a direction orthogonal to the longitudinal direction of the right and left fuel distribution pipes 34R and 34L, it is possible to enhance the stiffness with which the restricting member 46 is mounted on the support part 45.

Furthermore, since the restricting member 46 and the stay 44 for fixing the right and left fuel distribution pipes 34R and 34L are together fastened to the support part 45 by means of one of the pair of the bolts 53 and 54, it is possible to eliminate the necessity for a component exclusively used for fixing the stay 44 to the support part 45, thus reducing the number of components.

Moreover, since the plurality of restricting members 46 arranged side by side in the longitudinal direction of the right and left fuel distribution pipes 34R and 34L are disposed at a plurality of locations, for example two locations, spaced in the longitudinal direction of the right and left fuel distribution pipes 34R and 34L, even when the right and left fuel distribution pipes 34R and 34L are formed so as to be long, it is possible to retain and restrict the fuel distribution pipes 34R and 34L uniformly in the longitudinal direction by means of the pair of restricting members 46.

Furthermore, since the pair of restricting members 46 are disposed so as to coincide with the opposite end parts of the right and left fuel distribution pipes 34R and 34L, and the restricting members 46 and the fuel distribution pipes 34R and 34L are covered in common by the right and left manifold covers 60R and 60L, the range covered by the manifold covers 60R and 60L becomes large, and the manifold covers 60R and 60L can be fixed easily.

An embodiment of the present invention is explained above, but the present invention is not limited to the above embodiment and may be modified in a variety of ways as long as the modifications do not depart from the spirit and scope thereof.

For example, in the above embodiment, a case in which the present invention is applied to a horizontally-opposed six cylinder internal combustion engine E is explained, but the present invention may be applied to V-type multicylinder and in-line multicylinder internal combustion engines.

The invention claimed is:

1. A fuel supply device for an internal combustion engine, comprising a plurality of fuel injection valves that are disposed side by side in an engine main body of an internal combustion engine or in an intake system component forming part of an intake system connected to the engine main body, and a fuel distribution pipe that is connected in common to the fuel injection valves and supported via a support part provided on the intake system component or on the engine main body, wherein the fuel distribution pipe is formed from a pipe material, and a restricting member that is a separate member from the fuel distribution pipe is mounted on the support part at a position adjacent to the fuel distribution pipe so as to abut against the fuel distribution pipe to suppress displacement of the fuel distribution pipe from the support part.

2. The fuel supply device for an internal combustion engine according to claim 1, wherein the restricting member is formed from a plate material into a bowl shape having a ceiling wall and a peripheral wall connected to an outer peripheral edge of the ceiling wall, and a restricting wall portion abutting against the fuel distribution pipe is formed on part of the peripheral wall.

3. The fuel supply device for an internal combustion engine according to claim 2, wherein a recess part for avoiding interference with the fuel injection valve is formed by cutting out part of the peripheral wall of the restricting member.

4. The fuel supply device for an internal combustion engine according to claim 2, wherein a through hole is formed in the ceiling wall of the restricting member, a lead wire guided out from the fuel injection valve being inserted through the through hole.

5. The fuel supply device for an internal combustion engine according to claim 1, wherein the restricting member is fastened to the support part by means of a plurality of fastening members arranged side by side in a direction orthogonal to a longitudinal direction of the fuel distribution pipe.

6. The fuel supply device for an internal combustion engine according to claim 5, wherein the restricting member and a stay for fixing the fuel distribution pipe are together fastened to the support part by means of one of a pair of the fastening members.

7. The fuel supply device for an internal combustion engine according to claim 1, wherein a plurality of the restricting members arranged side by side in the longitudinal direction of the fuel distribution pipe are disposed at a plurality of locations spaced in the longitudinal direction of the fuel distribution pipe.

8. The fuel supply device for an internal combustion engine according to claim 7, wherein a pair of the restricting members are disposed so as to coincide with opposite end parts of the fuel distribution pipe, and the restricting members and the fuel distribution pipe are covered in common by a cover member.

* * * * *